United States Patent [19]

Dessig, III

[11] 4,307,485

[45] Dec. 29, 1981

[54] AIR-POWERED VACUUM CLEANER FLOOR TOOL

[75] Inventor: William R. Dessig, III, Cockeysville, Md.

[73] Assignee: Black & Decker Inc., Newark, Del.

[21] Appl. No.: 72,204

[22] Filed: Sep. 4, 1979

[51] Int. Cl.[3] ..... A47L 9/00

[52] U.S. Cl. ..... 15/325; 15/377; 15/387; 15/392; 15/410

[58] Field of Search ..... 15/325, 377, 387, 389, 15/392, 410, 351

[56] References Cited

U.S. PATENT DOCUMENTS

| | | | |
|---|---|---|---|
| 2,101,575 | 12/1937 | Dow . | |
| 2,314,081 | 3/1943 | Dow et al. | 15/387 |
| 2,659,098 | 11/1953 | Meyerhoefer | 15/325 X |
| 2,668,979 | 2/1954 | MacFarland | 15/392 X |
| 2,683,276 | 7/1954 | Olsen | 15/387 |
| 2,734,220 | 2/1956 | Tschudy | 15/410 |
| 2,962,748 | 12/1960 | Magarian | 15/387 |
| 2,963,270 | 12/1960 | Magarian | 253/40 |
| 3,005,224 | 10/1961 | Magarian | 15/392 X |
| 3,071,799 | 1/1963 | Jepson et al. | 15/354 |
| 3,354,496 | 11/1967 | Jonsson | 15/377 |
| 3,815,170 | 6/1974 | Brooks et al. | 15/377 X |
| 4,167,801 | 9/1979 | Erbor et al. | 15/354 |

*Primary Examiner*—Chris K. Moore

*Attorney, Agent, or Firm*—Harold Weinstein; Walter Ottesen; Edward D. Murphy

[57] ABSTRACT

A vacuum cleaner floor tool is provided which comprises a housing and an air-powered turbine motor within the housing. An agitator partially extends from the housing and is coupled to the turbine motor and driven thereby. At least one end of the agitator is supported by a substantially L-shaped spring metal strip having one end supported in a notch in the base plate of the floor tool and the other end supported on a stub on the base plate of the floor tool. The base plate of the floor tool is removably mounted on the housing and forms a wall thereof. The agitator extends from the housing through an opening in the base plate, and air passes through this opening into the turbine motor. The floor tool is coupled to a vacuum cleaner wand or hose by means of an elbow coupling, and the elbow coupling has a latch which comprises a protrusion on the elbow itself and a latch plate having a protrusion thereon, the latch plate being spring-biased towards the elbow coupling. The elbow latch enables the wand to be fixed in a vertical position with relation to the floor tool for storage, and enables the wand to be moved to a rotatable position during use. A bumper strip surrounds the housing, and a cover covers the housing. The cover has a notch therein which engages the bumper strip and holds it in place.

8 Claims, 26 Drawing Figures

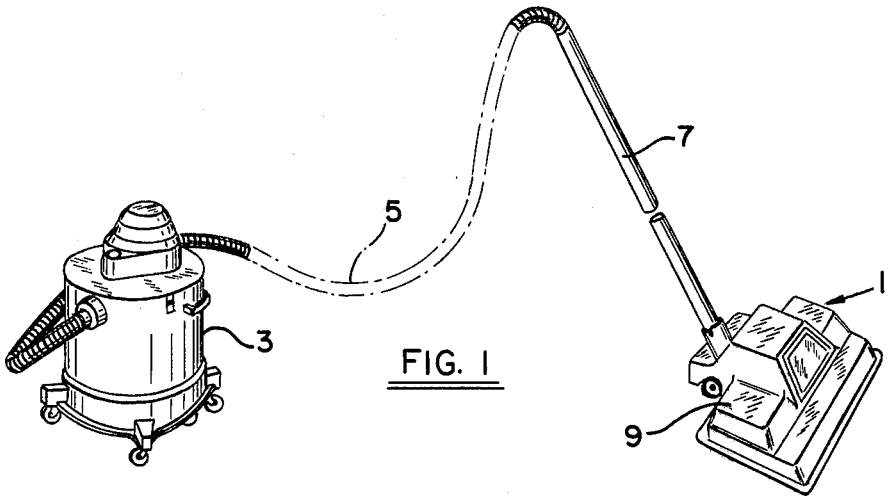
FIG. 1
FIG. 2
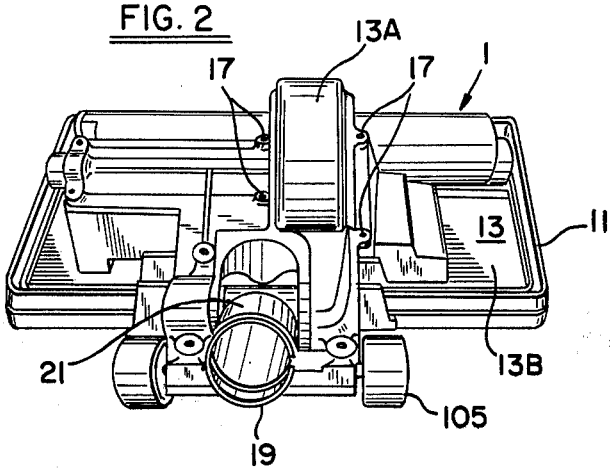
FIG. 3
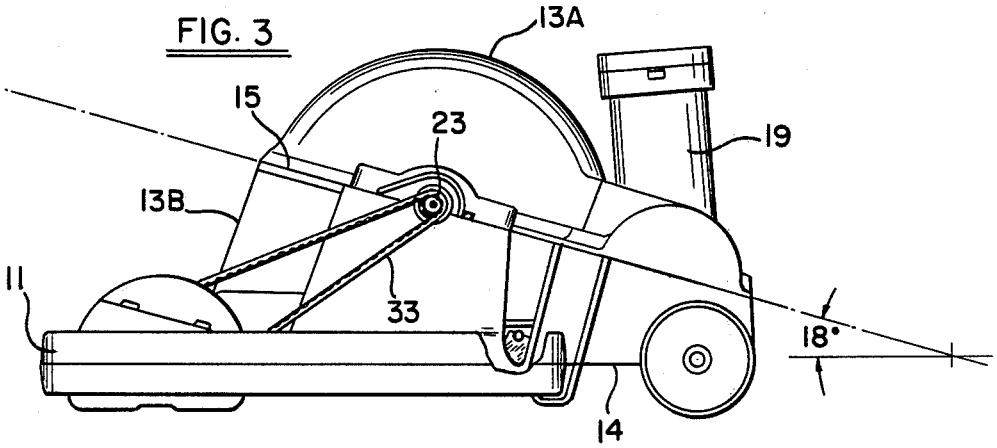

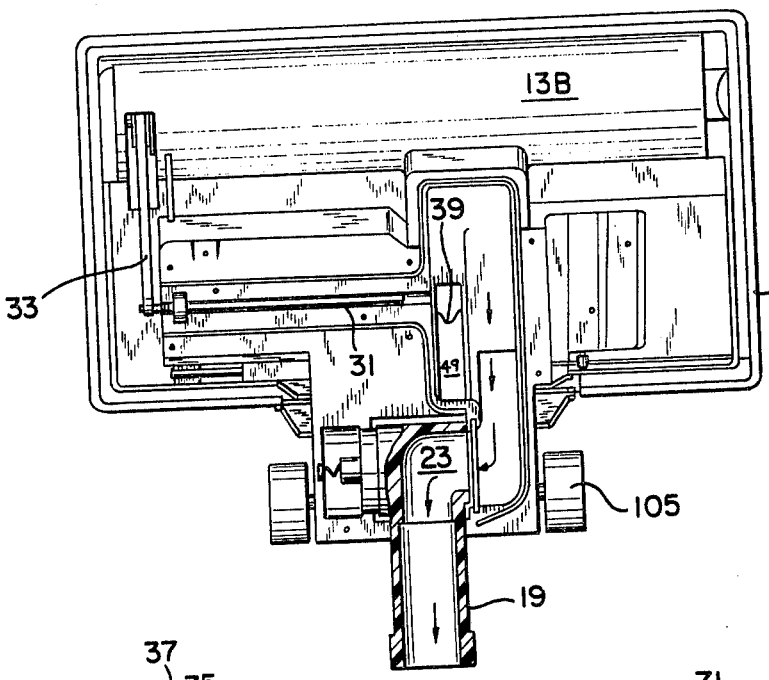
FIG. 4B
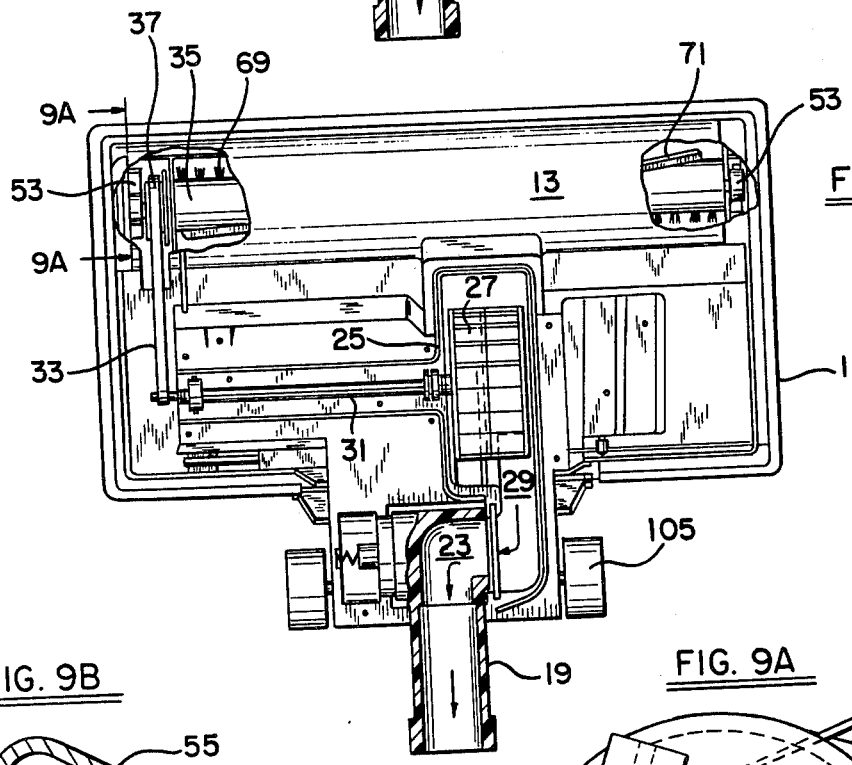
FIG. 4A
FIG. 9B
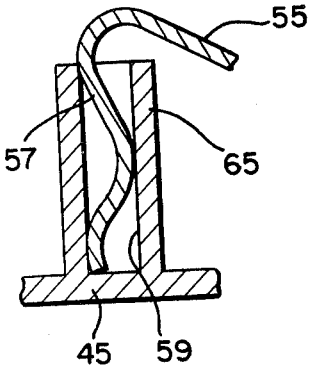
FIG. 9A
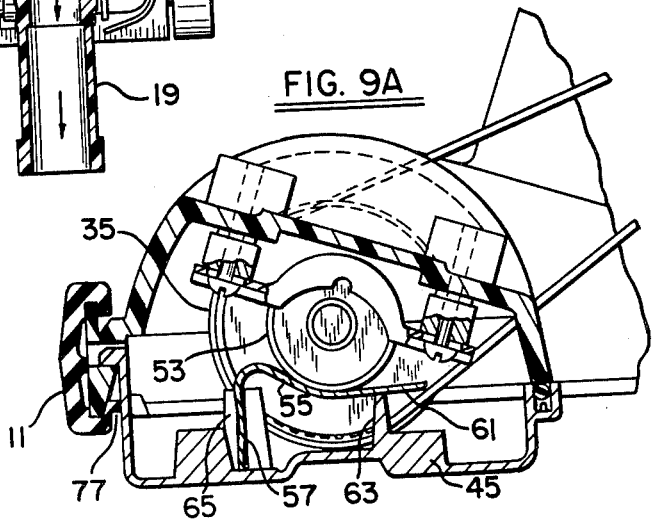

AIR-POWERED VACUUM CLEANER FLOOR TOOL

BACKGROUND OF THE INVENTION

1. Field of the Invention

This invention is related to a vacuum cleaner floor tool and, more particularly, to a vacuum cleaner floor tool having a turbine motor driven agitator which has an elbow latch for holding a vacuum cleaner wand in a fixed vertical position for storage, a notch in the floor tool cover for holding the bumper strip surrounding the housing in place, and a simple structure for supporting the agitator in the housing.

2. Description of the Prior Art

Vacuum cleaner floor tools having air-powered turbine motors for driving agitators are known in the prior art. Typical examples of these can be found among the following U.S. Pat. Nos. 2,683,276; 2,963,270; 3,071,799; 2,962,748; 3,005,224; 3,354,496.

All of these patents, however, suffer from various disadvantages. In Magarian U.S. Pat. No. 3,005,224, for example, the ramp which forms the nozzle to the air-powered turbine motor is a separate element from the base plate and, therefore, suffers from problems of alignment, difficult removal, etc. Furthermore, these patents do not disclose manually removable base plates to provide access to the interior of the turbine motor. Typically, these patents have screw-mounted base plates which require the use of a screw-driver for their removal and, in some instances, such as Magarian 3,005,224 noted above, have a small access hole in the base plate. The small access hole is not, however, adequate for the removal of many of the objects which may become lodged in the nozzle or turbine motor. Because of the small size of the hole, access is very limited.

Split clam-shell type housings have also been used in vacuum cleaner floor tools as, for example, in some of the patents cited above. However, these housings are not split along a single plane which is inclined with respect to the base or bottom of the lower housing member. The split housings of the prior art wherein the split is formed along more than one plane present difficulties in sealing the two housing members together, which is necessary in order to prevent leakage through the mating surfaces. In order to provide adequate sealing in the prior art, it is necessary that the pieces be formed with close tolerances and structurally complicated sealing means must be provided.

Elbow-type couplings for vacuum cleaner wands and hoses are also known in the prior art vacuum cleaner floor tools as, for example, those shown in the following U.S. Pat. Nos. 2,101,575; 2,734,220; 2,314,081; 3,071,799.

Some of the above patents disclose latching mechanisms which allow the extension portion of the elbow which connects to a vacuum cleaner wand to be placed in a fixed position, such as a vertical storage position, and in a rotatable position, such as that during the use of the vacuum cleaner. The latch mechanisms are, however, complicated, requiring a foot pedal, various nuts and bolts and structurally complicated parts.

The agitators in prior art vacuum cleaner floor tools are driven by either air-powered or electric motors within the floor tools. These agitators are coupled to the motors by various types of drive belts. Generally, a pulley connector is connected to the agitator by means of a press or friction fit, or by a special flat surface formed on the agitator. These structures require either separate manufacturing steps or, as in the specially formed surfaces, are subject to wear and slippage, such as in the press or friction fitted connectors.

SUMMARY OF THE INVENTION

It is an object of the present invention to provide a vacuum cleaner floor tool which has an elbow latch for latching the elbow coupling with couples the floor tool to a vacuum cleaner wand or hose. The latch structure is simple to manufacture and requires only a stamped metal plate and a spring. The structure does not require screws, rivets, etc.

It is another object of the present invention to provide a vacuum cleaner floor tool which has a bumper strip therearound, and which has a cover which covers the floor tool housing. The cover has a notch which engages the bumper strip and holds the bumper strip in place. The notch in the cover is a simple effective holding structure.

It is a further object of the present invention to provide a vacuum cleaner floor tool which includes a support for the rotary agitator where the support has one end mounted in a slot and another end supported by a stud, thereby providing a support which is simple and does not require screws, rivets, etc.

The present invention is directed to a vacuum cleaner floor tool which comprises a housing and an air-powered turbine motor within the housing. An agitator partially extends from the housing and is coupled to the turbine motor and driven thereby. At least one end of the agitator is supported by a substantially L-shaped spring metal strip having one end supported in a notch in the base plate of the floor tool, and the other end supported on a stud on the base plate of the floor tool. The base plate of the floor tool is removably mounted on the housing, and forms a wall thereof. The agitator extends from the housing to an opening in the base plate and air passes through this opening into the turbine motor. The floor tool is coupled to a vacuum cleaner wand or hose by means of an elbow coupling, and the elbow coupling has a latch which comprises a protrusion on the elbow itself, and a latch plate having a protrusion thereon, the latch plate being spring-biased towards the elbow coupling. The elbow latch enables the wand to be fixed in a vertical position with relation to the floor tool for storage, and enables the wand to be moved to a rotatable position during use. A bumper strip surrounds the housing and a cover covers the housing. The cover has a notch therein which engages the bumper strip and holds it in place.

One feature of the present invention is a latch for holding a vacuum cleaner wand or hose coupled to the floor tool in a fixed vertical position for storage and in rotatable position when the floor tool is in use. The floor tool has a rotatable elbow coupling with an extension portion and a cylindrical rotating portion. The cylindrical portion has a protrusion which extends therefrom, and the latch mechanism includes a latch plate having a protrusion which is opposed to the protrusion on the cylindrical portion of the elbow. The protrusion on the latch plate is biased towards the protrusion on the elbow coupling by means of a spring. This structure requires a minimum number of parts, which are simple to manufacture. The latch plate is made by stamping, for example, and the protrusion on the elbow can be made by molding during the molding of the elbow latch itself, thus requiring no additional manufacturing. The latch plate is hinged to the elbow using a pinless pivot arrangement, and the protrusion on the latch plate can be made wide and stiff, thereby eliminating the possibility of breaking or damage.

Another feature of the present invention is a cover which covers the floor tool housing. The cover has a notch therein which engages the bumper strip surrounding the housing and holds the bumper strip in place.

A further feature of the present invention is the support structure for the rotary agitator. The base plate is formed with a slot and stud aligned with one another along a line perpendicular to the axis of the agitator. A substantially L-shaped strip of spring metal is formed with one end portion of the strip being engaged in the slot, and the other end portion resting on the stud. The portion of the strip between the slot and the stud supports the agitator. This structure is very simple and requires no screws, rivets, etc. to hold the structure in place. Furthermore, the spring metal has no tab which can break. The support structure is easy to replace and does not require close tolerance.

BRIEF DESCRIPTION OF THE DRAWINGS

FIG. 1 is a perspective view of a vacuum cleaner connected to a floor tool of the present invention;

FIG. 2 is a perspective view of a floor tool of the preferred embodiment of the present invention with the cover removed;

FIG. 3 is an elevational view of the preferred embodiment of the present invention;

FIGS. 4A and 4B are top views of the preferred embodiment of the present invention, with the upper housing member removed;

FIG. 9A is an elevational view of an agitator support structure of the preferred embodiment of the present invention;

FIG. 9B is an enlarged partial section of FIG. 9A;

DETAILED DESCRIPTION OF THE PREFERRED EMBODIMENTS

Figure 6:
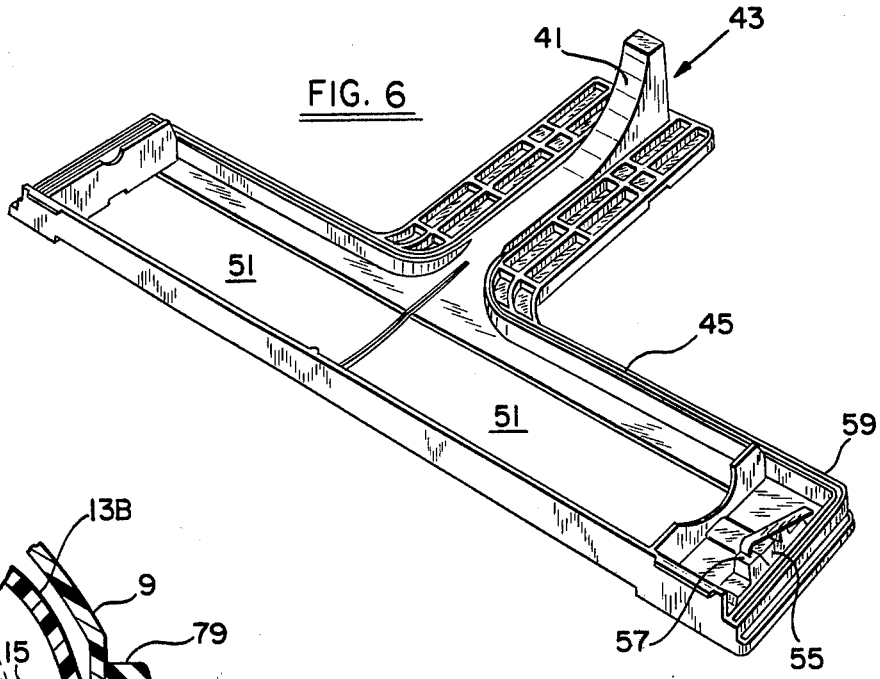
FIG. 6 is a perspective view of a base plate of the preferred embodiment of the present invention.

FIG. 1 illustrates a floor tool 1 of the present invention which is connected to a vacuum cleaner 3 by means of a hose 5 and a wand 7. The floor tool 1 of the present invention can be used with any type of vacuum cleaner, and the cannister-type cleaner 3 illustrated in FIG. 1 is merely by way of example. The floor tool 1 has a cover 9 which covers the upper portion thereof.

FIGS. 2 and 3 illustrate the floor tool with the cover 9 removed therefrom. A bumper strip 11 surrounds the housing 13 which has an upper member **13*a* and a lower member 13*b*. The members 13*a* and 13*b* mate with one another along a planar surface 15, the upper and lower members being held together by means of bolts or screws fitted into the holes 17**. This type of construction, wherein the housing is formed of an upper and a lower member, is referred to as a "claim shell" type of housing.

The surface 15 is inclined with respect to the plane of the base, or bottom 14 of the lower member **13*b*. The angle of inclination is preferably 18°. The angle of inclination of the surface 15 is significant because it permits the extension portion 19 of an elbow 21 to enter the housing 13 at a point below the axis 23 of a turbine motor which is within the housing, while simultaneously allowing the surface 15 to pass through the axis of the turbine motor. By positioning the axis of the elbow 21 on the surface 15 and below the axis 23, the operation of the floor tool is facilitated because, when an operator pushes the floor tool using the wand 7, the force is applied to a lower portion of the housing, thereby preventing a tipping of the housing over its forward end. Furthermore, since the axis 23 of the turbine motor must lie in the plane of surface 15, the inclination raises the height of the axis 23, thereby permitting the use of a larger size turbine which will, of course, result in greater motor torque and thereby enhance the efficiency of the vacuum cleaner floor tool. Also, since both axes, i.e, the axis of the coupling elbow 21 and the turbine motor axis 23**, lie in the same plane, which is the plane between the upper and lower members of the housing, the present invention eliminates the necessity for a stepped surface between the upper and lower members of the housing which would create sealing and tolerance problems.

FIG. 4A shows the floor tool of the present invention with the upper member of the housing 13A removed. The turbine motor 25 includes a rotor 27 which is positioned in a turbine chamber 29 formed by the upper and lower housing members **13*a* and 13*b*. Shaft 31, which lies on axis 23 of the turbine rotor, rotates with the turbine rotor and a drive belt 33 couples the shaft to a rotary agitator 35 through a pulley or connector 37**.

Referring to FIGS. 4–8, the nozzle of the air-powered turbine motor 25 is formed by the walls 39 of the housing member **13*b* and the face 41 of ramp 43, which is integrally formed on base plate 45. The base plate 45 is removably positioned on the bottom of lower housing 13*b* and, in FIG. 7, the dashed lines illustrate the base plate 45 in its partially withdrawn position and the solid lines illustrate it in its normally closed position. The nozzle for the turbine motor is shown at 47. Referring to FIG. 4B, which corresponds to FIG. 4A with the turbine rotor removed, the ramp 43 extends into the opening 49 in the housing member 13*b* to form the nozzle 47, along with the face 41 of the ramp 43. The base plate 45 has a large opening 51 with the rotary brush agitator 35 partially extended through the opening 51. In operation the air for the turbine motor 25 is drawn through the opening 51 and through the nozzle 47 formed by the ramp 41 and the walls 39 of the housing 13*b* into the turbine motor 25. A pressure differential is created across the turbine motor by coupling the elbow extension 19 to a vacuum cleaner, as illustrated in FIG. 1**.

The rotation of the turbine rotor 25 is transmitted to the rotary agitator 35 by means of shaft 31, belt 33 and connector 37 to rotate the brush which agitates carpeting, for example, to enhance the removal of dirt therefrom by means of the vacuum cleaner.

Referring to FIGS. 4A, 5A and 10–12, the agitator 35 has therein a plurality of spiral grooves 67 which have therein either brushes 69 or beater bars 71. The brushes 69 or beater bars 71 agitate the carpeting to loosen dirt therein as the rotary agitator is rotated by the turbine motor. The end portion 73 of the rotary agitator 35 is reduced or turned down to a diameter in which the spiral grooves 67 are substantially flat surfaces 67*a*. The connector 37 is mounted on the reduced diameter end portion 73 of the rotary agitator 35. The connector 37 has lugs (not shown) which mate with the flat surfaces 67*a*, thereby preventing relative rotation between the connector 37 and the rotary agitator 35. The drive belt 33 drives the connector 37 which, in turn, drives the rotary agitator 35. The lugs and flat surfaces 67*a* cooperate to prevent slippage.

Figure 5B:
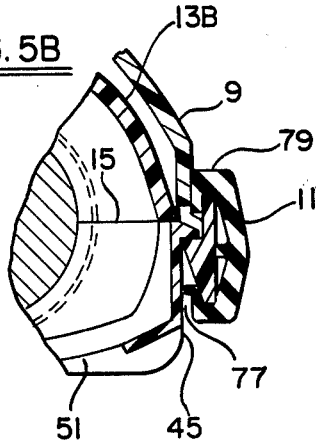
FIG. 5B is an enlarged partial section of FIG. 5A.
Figure 5A:
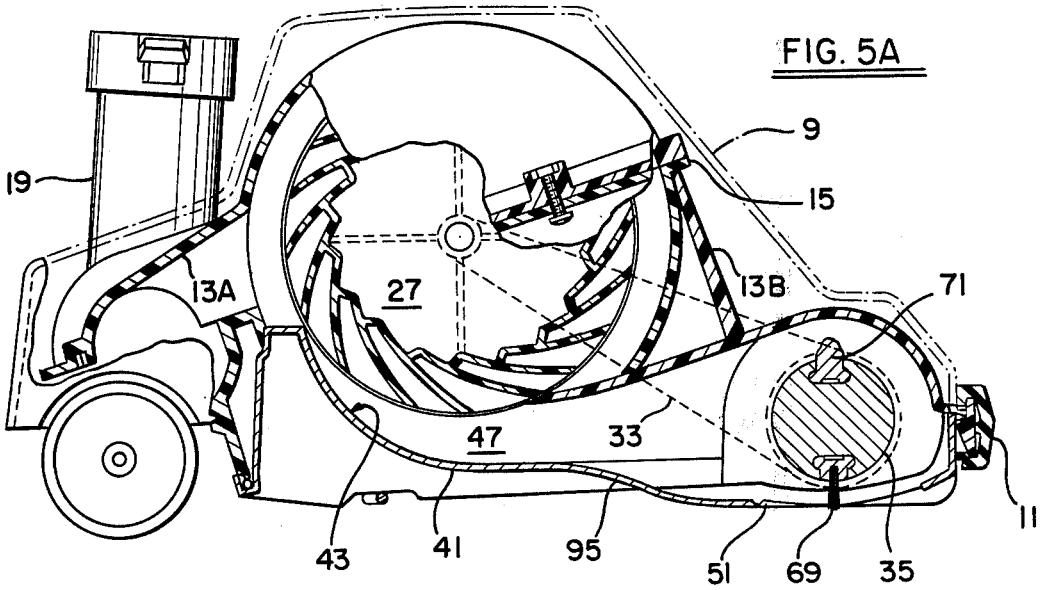
FIG. 5A is an elevational view of the invention, partially in section.
Figure 7:
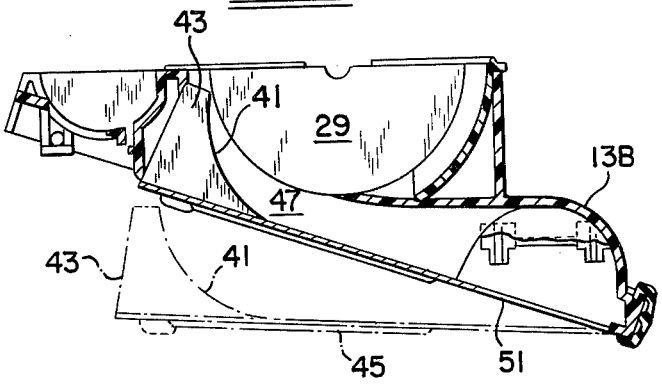
FIG. 7 is a sectional view of the base plate of the preferred embodiment of the present invention, mounted on the floor tool housing.
Figure 8:
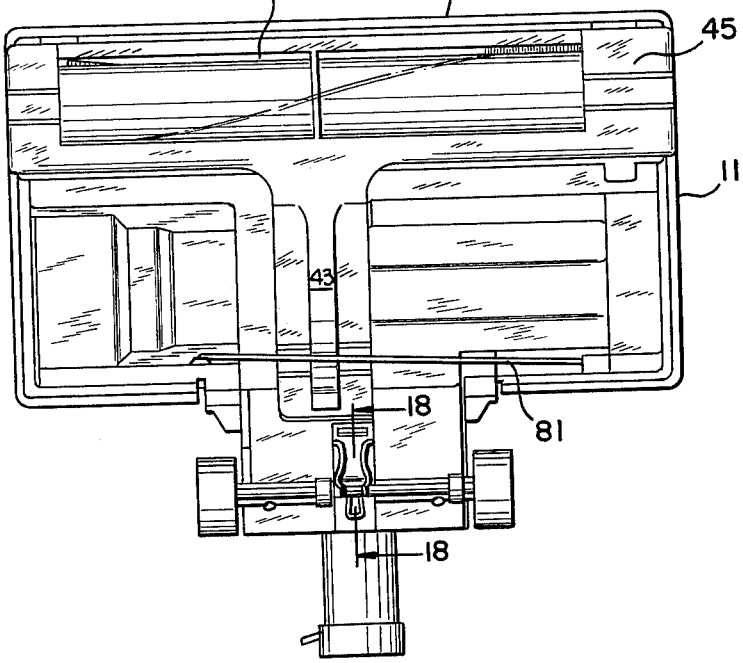
FIG. 8 is a bottom view of a vacuum cleaner floor tool of the preferred embodiment of the present invention.
Figure 10:
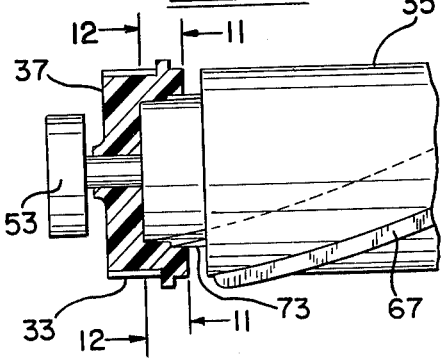
FIGS. 10–12 illustrate the preferred embodiment of the agitator drive coupling of the present invention.
Figure 11:
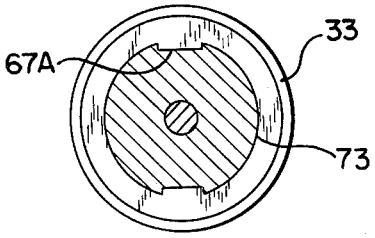
Figure 12:
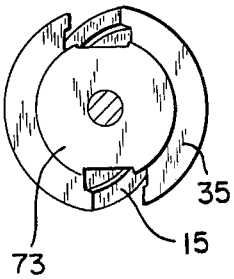

Referring to FIGS. 5A, 5B and 6, air is drawn into the housing 13 through the opening 51 in the base plate 45. In order to optimize the cleaning efficiency of the vacuum cleaner floor tool, all of the air should be drawn through the opening 51. In order to eliminate passage of air through the surface between the lower housing member 13*b* and the base plate 45, the bumper strip 11 has a small lip or extension 77 which forms an air seal with the base plate 45. This lip is integrally formed as part of the bumper strip. The top portion 79 of the bumper strip 11 forms a seal with the housing cover 9 which acts to prevent dislodging of the bumper along its perimeter.

Figure 13A:
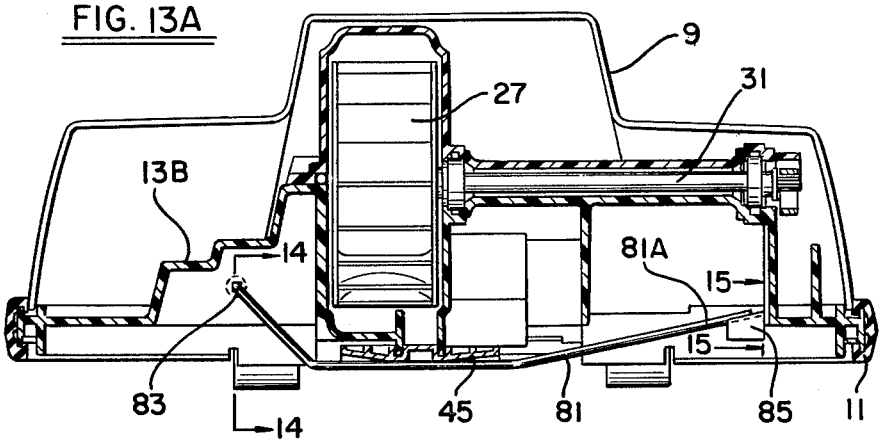
FIGS. 13A, 13B, 14 and 15 illustrate the preferred embodiment of the base plate retaining device of the present invention.
Figure 13B:
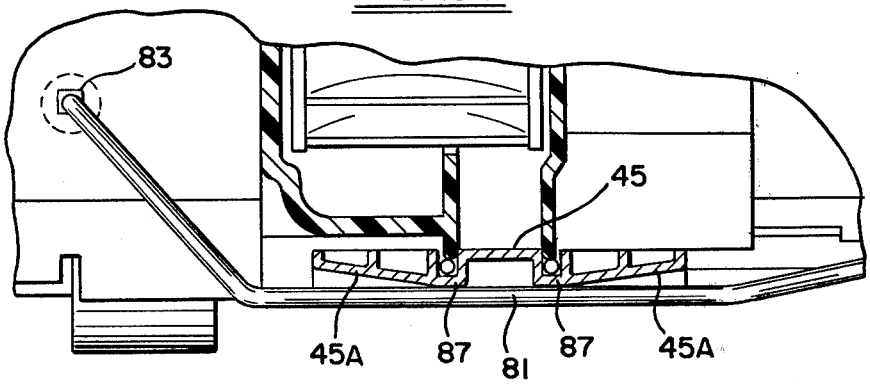
Figure 14:
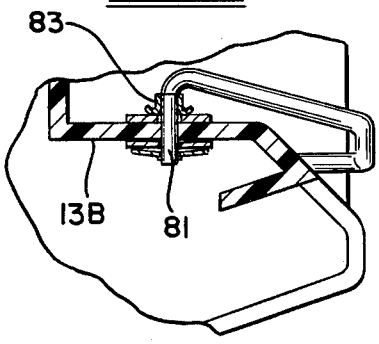
Figure 15:
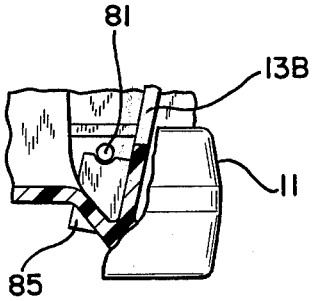

Referring to FIGS. 13–15, the removable base plate 45 is held in place by a retaining rod 81. The rod 81 is pivotally mounted in the lower housing member 13*b* at 83. The other end 81*a* of the retaining rod 81 engages a projection 85 which may be integrally formed in the lower housing member 13*b*. The base plate 45 has inclined portions 45*a* so that the retaining rod 81 engages and holds the base plate at points 87 near the longitudinal center of the base plate. This provides an even distribution of force by the retaining rod to hold the base plate in place.

When it is desired to remove the base plate 45 in order to remove an object which may have become lodged in the turbine chamber, the end 81*a* of the retaining rod 81 is manually lifted from the projection 85 and pivoted about point 83. This results in the disengagement of the retaining rod 81 from the base plate 45, and the positioning of the rod 81 in a non-obstructing position. The base plate 45 may then be lifted out of the housing 13, thereby exposing the interior of the turbine chamber.

Referring to FIGS. 6 and 9, the ends of the rotary agitator 35 have bearings 53 which are supported by springs 55. The springs 55 have ends 57 which are inserted into slots 59 formed in a boss 65 of the base plate 45, while the other ends 61 are supported on studs 63 formed on the base plate 45. The springs 55 are held in slots 59 by means of the bent end portions 57.

Figure 16:
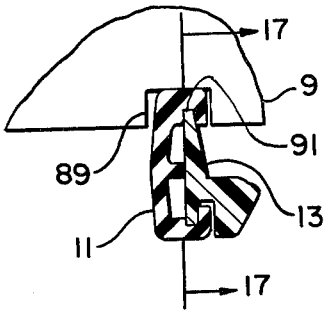
FIGS. 16 and 17 illustrate the preferred embodiment of the bumper strip retaining structure of the present invention.
Figure 17:
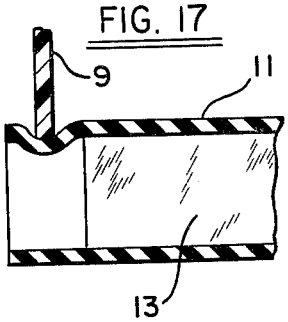

Referring to FIGS. 16 and 17, the bumper strip 11 is held in place by means of a notch 89 in the rear portion of the cover 9. When the cover is placed over the housing 13, the notch engages the upper portion of the bumper strip 11 and holds it against the edge 91 of the housing 13. This prevents the bumper strip from separating from the housing and holds it in place on the housing 13.

Figure 20:
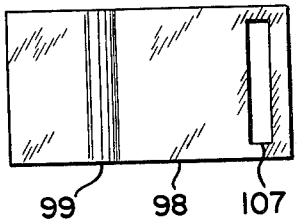
FIG. 18–20 illustrate the preferred embodiment of the elbow latch structure of the present invention.
Figure 18:
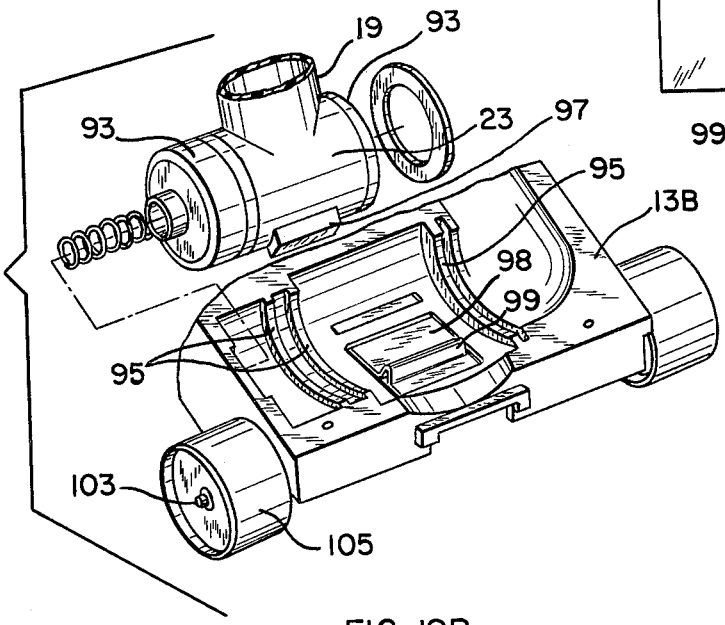

Referring to FIGS. 18–20, the vacuum cleaner coupling or elbow 23 has an extension portion 19 and a cylindrical portion 93. The cylindrical portion 93 sits in a socket 95 in the lower member 13*b* of the housing. Cylindrical portion 93 has a protrusion 97 extending therefrom and integral therewith. The protrusion 97 is formed during the molding or manufacturing of the elbow 23. Within the socket 95 is positioned a latch plate 98, which has a protrusion 99. The protrusion 99 is positioned opposite the protrusion 97 on the cylindrical portion 93. A spring 101 biases the plate 98 towards the cylindrical portion 93. The spring 101 is mounted on axle 103 of wheels 105. Plate 98 also has a slot 107 which engages a member 109 integrally formed in the housing member 13*b* so that the plate 98 can pivot about this member 109.

Figure 19A:
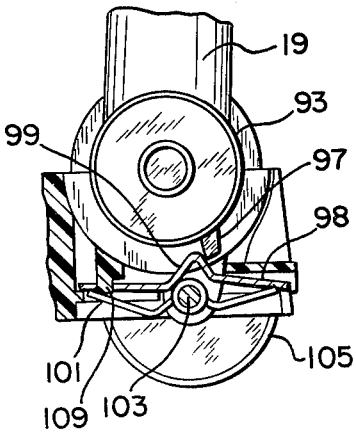
Figure 19B:
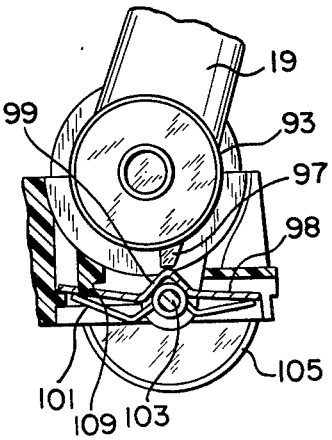

FIG. 19A illustrates the extension 19 in a substantially fixed vertical position. This position is usually used for storage when a wand is connected to the floor tool, and the floor tool and wand are stored with the wand in the vertical position. As can be seen, the protrusion 97 engages protrusion 99 and the extension 19 is held in a fixed vertical position.

Figure 19C:
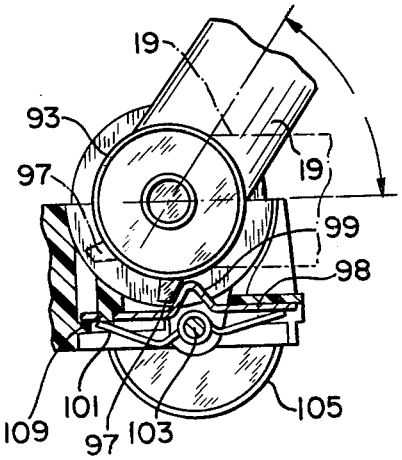

When using the floor tool, the wand is usually held in a non-vertical position. FIG. 19C illustrates the wand in its normal operating position. In this position, the protrusion 97 has been moved to the position illustrated, which allows the rotation of the cylindrical portion 93 about is axis. In going from the position illustrated in FIG. 19A to that illustrated in FIG. 19C, the latch passes through the position shown in FIG. 19B. In this position, the protrusion 97 pushes down against protrusion 99 and protrusion 99 moves downward against the force of spring 101. However, when the latch reaches the position in FIGS. 19A or 19C, the spring 101 biases the plate back up again.

The present invention may be embodied in other specific forms without departing from the spirit or essential characteristics thereof. The presently disclosed embodiments are, therefore, to be considered in all respects as being illustrative and not restrictive. The scope of this invention is intended to be indicated by the appended claims, rather than the foregoing description, and all changes which come within the meaning and range of equivalency of the claims are to be embraced therein.

What is claimed is:

1. A vacuum cleaner floor tool comprising:

(a) a housing;

(b) an air-powered turbine motor;

(c) agitator means partially extending from said housing, said agitator means being coupled to said turbine motor and being driven thereby;

(d) base plate means removably mounted on said housing and forming a wall thereof, said agitator means extending from said housing through an opening in said base plate means, said base plate means including a slot means, a stud means, said slot means and said stud means being positioned on a line perpendicular to the axis of said agitator means, and a spring means, wherein said slot means receives one end portion of said spring means and wherein the other end portion of said spring means is supported by the stud means, wherein at least one end of said agitator means is supported by said spring means;

(e) wand coupling means for coupling said turbine motor to a vacuum cleaner wand, said wand coupling means having a first portion rotatably mounted in said housing, an extension extending from said first portion, and a latch means for holding said extension means in a fixed state or in a rotatable state, said latch means comprising a first protrusion extending from said first portion, and a plate member pivotally mounted in said housing, said plate member having a second protrusion thereon, said second protrusion being opposed to said first protrusion, wherein when said first protrusion is on one side of said second protrusion, said extension is in said fixed state and when said first protrusion is on the other side of said second protrusion, said extension is in said rotatable state.

2. A vacuum cleaner floor tool comprising:

(a) a housing;

(b) an air-powered turbine motor;

(c) agitator means partially extending from said housing, said agitator means being coupled to said turbine motor and being driven thereby;

(d) base plate means removably mounted on said housing and forming a wall thereof, said agitator means extending from said housing through an opening in said base plate means, wherein air passes through said opening in said base plate means into said turbine motor, said base plate means including at least one slot means, at least one stud means, said slot means and said stud means being positioned on a line perpendicular to the axis of said agitator means, and spring means, wherein said slot means receives one end portion of said spring means and wherein the other end portion of said spring means is supported by said stud means, and wherein one end of said agitator means is supported by said spring means.

3. A vacuum cleaner floor tool as set forth in claim 2 wherein said one end portion of said spring means has a bulged portion therein for engaging the sides of said slot means, thereby holding said spring means in said slot means.

4. A vacuum cleaner floor tool as set forth in claim 2 including a bumper strip mounted on said housing and surrounding said housing; said floor tool further including a cover means for covering said housing, said cover means having notch therein, said notch engaging said bumper strip and holding said bumper strip against said housing to prevent said bumper strip from separating from said housing.

5. A vacuum cleaner floor tool comprising:

(a) a housing;

(b) a bumper strip mounted on said housing and surrounding said housing;

(c) cover means covering said housing, said cover means having notch means therein, said notch means engaging said bumper strip and holding said bumper strip against said housing to prevent said bumper strip from separating from said housing;

(d) an air-powered turbine motor;

(e) agitator means partially extending from said housing, said agitator means being coupled to said turbine motor and being driven thereby;

(f) base plate means removably mounted on said housing and forming a wall thereof, said agitator means extending from said housing through an opening in said base plate means, wherein air passes through said opening in said base plate means into said turbine motor, said base plate means including a slot means, a stud means, said slot means and said stud means being positioned on a line perpendicular to the axis of said agitator means, and spring means, wherein said slot means receives one end portion of said spring means and wherein the other end portion of said spring means is supported by said stud means, and wherein one end of said agitator means is supported by said spring means; and (g) wand coupling means for coupling said turbine motor to a vacuum cleaner, said coupling means having a first portion rotatably mounted in said housing, an extension extending from said first portion, and a latch means for holding said extension in a fixed state or in a rotatable state, said latch means comprising a first protrusion extending from said first portion and a plate member pivotally mounted in said housing, said plate member having a second protrusion thereon, said second protrusion being opposed to said first protrusion, wherein when said first protrusion is on one side of said second protrusion, said extension is in said fixed state and when said first protrusion is on the other side of said protrusion, said extension is in said rotatable state.

6. A vacuum cleaner floor tool as set forth in claim 5 wherein said latch member includes spring means for biasing said plate means towards said first portion.

7. A vacuum cleaner floor tool as set forth in claim 6 wherein said plate member includes a slot therein and said housing includes a projection for engaging said slot such that said plate member pivots about said projection.

8. A vacuum cleaner floor tool as set forth in claim 5 wherein said one end of said spring means has a bulged portion therein for engaging the side of said slot means, thereby holding said spring means in said slot means.

* * * * *